US007842655B2

(12) United States Patent
Guida et al.

(10) Patent No.: US 7,842,655 B2
(45) Date of Patent: Nov. 30, 2010

(54) COLORED BLEACHING COMPOSITION

(75) Inventors: Vincenzo Guida, Rome (IT); Bruna Perfili, Rome (IT); Luca Sarcinelli, Cerveteri (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/428,618

(22) Filed: Apr. 23, 2009

(65) Prior Publication Data

US 2009/0265862 A1 Oct. 29, 2009

(30) Foreign Application Priority Data

Apr. 25, 2008 (EP) ..... 08155156

(51) Int. Cl.
*C11D 7/14* (2006.01)
*C11D 7/26* (2006.01)
*C11D 7/54* (2006.01)

(52) U.S. Cl. ..... 510/303; 510/380; 510/466; 510/488; 510/505; 510/511; 252/186.34; 8/108.1

(58) Field of Classification Search ..... 510/303, 510/380, 466, 488, 505, 511; 252/186.34
See application file for complete search history.

(56) References Cited

U.S. PATENT DOCUMENTS

| | | | | |
|---|---|---|---|---|
| 2,082,275 | A | 6/1937 | Daimler et al. | |
| 2,255,082 | A | 9/1941 | Orthner et al. | |
| 2,438,091 | A | 3/1948 | Lynch | |
| 2,528,378 | A | 10/1950 | Mannheimer | |
| 2,658,072 | A | 11/1953 | Kosmin | |
| 2,702,279 | A | 2/1955 | Funderburk et al. | |
| 3,812,044 | A | 5/1974 | Connor et al. | |
| 4,065,545 | A * | 12/1977 | Gamlen | 423/265 |
| 4,474,677 | A | 10/1984 | Foxlee | |
| 4,704,233 | A | 11/1987 | Hartman et al. | |
| 4,764,302 | A | 8/1988 | Baker et al. | |
| 4,790,856 | A | 12/1988 | Wixon | |
| 5,035,825 | A | 7/1991 | Eckhardt et al. | |
| 5,229,027 | A * | 7/1993 | Ahmed | 510/221 |
| 5,236,614 | A | 8/1993 | Jacquet et al. | |
| 5,914,069 | A | 6/1999 | Agostini et al. | |
| 6,090,770 | A * | 7/2000 | Mendoza et al. | 510/380 |
| 6,313,082 | B1 | 11/2001 | Scialla et al. | |
| 6,475,970 | B1 | 11/2002 | Del Duca et al. | |
| 6,894,015 | B1 | 5/2005 | Briatore et al. | |
| 2004/0023837 | A1 * | 2/2004 | Zanardi et al. | 510/499 |
| 2004/0192571 | A1 | 9/2004 | Briatore et al. | |
| 2006/0183657 | A1 | 8/2006 | Resta et al. | |
| 2007/0027054 | A1 * | 2/2007 | Briatore et al. | 510/379 |
| 2007/0287651 | A1 | 12/2007 | Sarcinelli et al. | |

FOREIGN PATENT DOCUMENTS

| | | |
|---|---|---|
| EP | 688857 | * 12/1995 |
| GB | 2 271 119 A | 4/1994 |

OTHER PUBLICATIONS

Sarkar, A. K., Fluorescent Whitening Agents, Merrow Publishing Company, 1971, pp. 71-72.
International Search Report, International Application No. PCT/US2009/040740, mailed Sep. 30, 2009, 5 pages.

* cited by examiner

*Primary Examiner*—Gregory R Del Cotto
(74) *Attorney, Agent, or Firm*—Andrew J. Mueller; Leonard W. Lewis

(57) ABSTRACT

Liquid bleaching composition comprising a hypohalite bleach, a trimethoxy benzoic acid or a salt thereof, a pigment and/or a dye and an alkali metal salt of silicate, an alkali metal periodate or mixture thereof and the process for treating a surface using said composition.

9 Claims, No Drawings

COLORED BLEACHING COMPOSITION

FIELD OF THE INVENTION

The present invention relates to bleaching compositions, in particular to colored hypohalite bleaching compositions which can be used to treat various surfaces.

BACKGROUND OF THE INVENTION

Bleach-containing compositions for bleaching various surfaces, such as fabrics for example, are well known in the art. Amongst the different bleaching compositions available, those relying on bleaching by hypohalite bleach, such as hypochlorite, are often preferred, mainly for bleaching performance reasons. However, such hypohalite bleach composition often faced stability problems. Thus an objective of bleach manufacturers has always been to obtain a bleach product that is chemically and physically stable over time, for example, over periods of storage.

In addition, it is often desirable to add further ingredients, such as dyes or pigments, to hypohalite bleach-containing compositions in order to improve the aesthetics of such compositions. Indeed, coloured bleaching compositions are particularly preferred compositions. As a matter of fact, the distinct appearance of the composition facilitates it's recognition by consumers, thereby reducing potential misuse or consumption of a potentially irritant composition.

However, formulating such coloured bleaching composition has been a constant challenge due to the aggressive nature of hypohalite bleaches. Such formulations often results in variety of stability related problems.

A drawback associated with coloured hypohalite bleach-containing compositions is that pigments and/or dyes, present herein, are decomposed by the bleach. Indeed, hypohalite bleaches are oxidising agents and pigments and dyes are very prone to attacks. In some cases such compounds can even be completely decomposed by such oxidising agents.

This decomposition results, therefore, in the loss of color of the composition and, even, sometimes, in the settling of pigments to the bottom of containers containing such composition. Moreover, as a consequence of the interaction of such components with the oxidising agent, a premature decomposition of the oxidising agent and of other actives present in the composition occurs, leading to a less efficient composition in term of cleaning performances for example. In addition, during oxidation, dyes and/or pigments release ions which attack oxidising agents, resulting thus in the acceleration of the decomposition of such agents.

It is thus an object of the present invention to provide a hypohalite-containing composition, comprising a pigment and/or a dye, in which the pigment is chemically stable and wherein the cleaning performances of the composition are maintained.

It is known in the art to add a stabilising agent to hypohalite bleach-containing compositions in order to prevent, or at least reduce, the decomposition of further ingredients, in particular pigments and/or dye, present in such compositions.

For example, EP-A-0 668 345 and EP-A-1 001 010 relates to bleaching compositions comprising a hypohalite bleach and a radical scavenger. However, even though such stabilization systems, and especially radical scavengers, are capable of stabilising further ingredients, it has been found that pigments and/or dyes are still particularly prone to attacks by hypohalite bleaches and hence are extremely difficult to be stably incorporated into bleaching compositions comprising the known stabilization systems.

Thus, although the systems described in the art provide stabilisation of further ingredients in hypohalite bleach-containing compositions, it has been found that the stabilization of pigments and/or dyes and of the composition may still be further improved.

It is therefore an objective of the present invention to provide hypohalite bleach-containing compositions having excellent bleaching performances and comprising pigments and/or dyes, wherein the decomposition of said ingredients is significantly reduced.

It has now been found that this objective can be met by a hypohalite liquid bleaching composition comprising a pigment and/or a dye, a trimethoxy benzoic acid or a salt thereof, and an alkali metal salt of silicate, an alkali metal periodate or mixture thereof.

Advantageously, the bleaching composition as described herein provides a significant reduction of the decomposition of pigments and/or dyes upon storage of said bleaching composition. Another advantage of the bleaching compositions according to the present invention is that they show excellent bleaching performances. Indeed, the oxidizing agent is not decomposed upon storage of said composition. In particular, the compositions of the present invention provide excellent bleaching performance when used in any laundry application ("fabric treatment applications"), e.g., as a laundry detergent, a laundry additive and/or a laundry pretreater.

A further advantage of the compositions of the present invention is that they are suitable for the cleaning of different types of fabrics including natural fabrics (e.g., fabrics made of cotton, viscose, linen, silk and wool), synthetic fabrics such as those made of polymeric fibers of synthetic origin as well as those made of both natural and synthetic fibers.

Yet another advantage of the bleaching compositions of the present invention is that said bleaching compositions are also suitable for the bleaching of different types of surfaces including hard-surfaces like floors, walls, tiles, glass, kitchen surfaces, bathrooms surfaces, toilet bowls and/or dishes and the like, in addition to the above mentioned fabric treatment applications.

SUMMARY OF THE INVENTION

The present invention encompasses a liquid bleaching composition comprising a hypohalite bleach, a trimethoxy benzoic acid or a salt thereof, a pigment and/or a dye and an alkali metal salt of silicate, an alkali metal periodate or mixture thereof.

In another aspect, the present invention also relates to process for treating a surface using the composition of the present invention.

DETAILED DESCRIPTION OF THE INVENTION

The Bleaching Composition

The bleaching compositions herein described are formulated as liquids compositions, including gel and paste form. The bleaching compositions are, preferably, but not necessarily, formulated as aqueous compositions. Preferred liquid bleaching compositions of the present invention are aqueous and therefore, preferably, may comprise water, more preferably may comprise water in an amount of from 60% to 98%, even more preferably of from 80% to 97% and most preferably 85% to 97% by weight of the total composition.

An essential aspect of the present invention is that the composition is stable on storage. By "stable on storage", it is to be understood that the compositions of the present invention typically do not undergo more than 25% loss of available oxidising agent after 5 days of storage at 50° C.±0.5° C. and more preferably not more than 20%. The percentage of loss of available chlorine may be measured using the method described, for instance, in "Analyses des Eaux et Extraits de Javel" by "La chambre syndicate nationale de L'eau de Javel et des produits connexes", pages 9-10 (1984). Said method consists in measuring the available oxidising agent in the fresh compositions, i.e. just after they are made, and in the same compositions after 5 days at 50° C.

The compositions according to the present invention are preferably alkaline compositions. The pH of the liquid compositions herein is from 7.5 to 14, preferably from 8 to 13 when measured at 25° C. It is in this alkaline range that the optimum stability and performance of the composition as well as fabric whiteness and/or safety are obtained.

Accordingly, the compositions herein may further comprise an acid or a source of alkalinity to adjust the pH as appropriate. Suitable sources of alkalinity are the caustic alkalis such as sodium hydroxide, potassium hydroxide and/or lithium hydroxide, and/or the alkali metal oxides such as sodium and/or potassium oxide. A preferred source of alkalinity is a caustic alkali, more preferably sodium hydroxide and/or potassium hydroxide. Typical levels of such sources of alkalinity, when present, are of from 0.1% to 2% by weight, preferably from 0.5% to 1.5% by weight of the composition.

Hypohalite Bleach

As a first essential ingredient, the bleaching compositions of the present invention comprise a hypohalite bleach.

Suitable hypohalite bleaches may be provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins. In a preferred embodiment, said hypohalite bleach is an alkali metal and/or alkaline earth metal hypochlorite. More preferably, said hypohalite bleach is an alkali metal and/or alkaline earth metal hypochlorite selected from the group consisting of sodium hypochlorite, potassium hypochlorite, magnesium hypochlorite, lithium hypochlorite and calcium hypochlorite, and mixtures thereof. Even more preferably, said hypohalite bleach is sodium hypochlorite.

Preferably, the liquid bleaching compositions herein comprise hypohalite bleach such that the content of active halide (for hypochlorite: $AvCl_2$) in the composition is of from 0.01% to 20% by weight, more preferably from 0.1% to 10% by weight, even more preferably from 0.5% to 7% and most preferably from 1% to 6% by weight of the composition.

Pigment

As another essential ingredient, the compositions of the present invention comprise a pigment and/or a dye or mixture thereof. The presence of a pigment and/or a dye in the composition of the present invention is essential to provide a colored bleaching composition. Preferably, the pigment of the present invention is a metal-phthalocyanine pigment.

The metal, in the metal-phthalocyanine pigment, can be any metal with which phthalocyanine forms a metal chelate complex, such as Cu, Ni, Mg, Pt, AI, Co, Pb, Ba. Preferably, the metal-phthalocyanine pigments contained in the bleaching composition of the present invention is a copper-phthalocyanine pigment. In a highly preferred embodiment according to the present invention, the pigment used in the present invention herein is blue copper phthalocyanine pigment.

Blue copper phtalocyanine is commercially available under the tradename Dye Pigmosol Blue 15®, from BASF); Direct Blue 86 (commercially available under the tradename Iragon Blue DBL86® from Clariant); Pigment Blue 15:1 (commercially available under the tradename Disperse Blue 69-007® from BASF); and Pigment Blue 15:3 (commercially available under the tradename Hostafine Blue B2G® from Clariant); and mixtures thereof.

The pigment and/or dye, or mixture thereof, is present in the compositions of the present invention at levels of from 0.0001% to 0.5%, preferably from 0.0002% to 0.05%, more preferably from 0.0005% to 0.005% and most preferably from 0.0005% to 0.003%.

Silicate, Periodate

As another essential ingredient, the compositions of the present invention comprise an alkali metal salt of silicate, an alkali metal periodate or mixtures thereof. Preferably, the compositions of the present invention will comprise alkali metal salt of silicate. More preferably, the compositions of the present invention will comprise mixture of an alkali metal salt of silicate and periodate. Indeed, when these two ingredients are present in the composition according to the present invention a synergetic effect on stability of the pigment and of the oxidising agent is obtained As alkali metal salt of silicate, it is meant herein an alkali metal salt of silicate or polysilicates, or mixtures thereof. The preferred alkali metal salt of silicate to be used herein is sodium silicate. Preferred compositions of the present invention comprise from 0.005% to 5% by weight of the total composition of an alkali metal salt of silicate, or mixtures thereof, preferably from 0.01% to 2% and more preferably from 0.05% to 1%.

As alkali metal periodate, it is meant herein any alkali metal periodate or mixtures thereof. The periodates may be added as such or may be made in situ, in the composition of the present invention, by any suitable reactions of appropriate iodine compounds, such as the oxidation of an iodide salt.

Accordingly suitable periodates for use in the present compositions include alkali metal periodates such as sodium and potassium periodates. Preferred herein is to use potassium periodate.

The compositions used in the present invention comprise more than 0.005% by weight of the total composition of said periodate, or mixtures thereof, preferably from 0.01% to 2% and more preferably of from 0.05% to 1%.

It has been found that alkali metal salt of silicate, alkali metal periodate or mixtures thereof, such as sodium silicate and potassium periodate, have an excellent effect on chemical stabilization of the bleaching composition. Indeed, without being bound to the theory, it is believed that such compounds protect pigments and/or dyes from being attacked by the oxidising agent coming from hypochlorite. This results, thus, in a stable amount of pigment/dye in the composition.

Furthermore, it has been found that alkali metal salt of silicate, an alkali metal salt of periodate or mixtures thereof prevent the decomposition of the radical scavengers, such as a trimethoxy benzoic acid, which lead thus to a even more efficient and stable bleaching composition.

Moreover, it has been found that the presence of alkali metal salt of silicate, alkali metal periodate or mixtures thereof, such as sodium silicate and potassium periodate in the composition result also, indirectly, in a reduce decomposition of the bleaching agent present in said composition.

Indeed, it is believed that pigments and/or dyes, such as copper-phthalocyanine, when decomposed by oxidizing agent, release free metal ion, such as copper, which results in the acceleration of hypohalite decomposition.

Thus, a further advantage of the bleaching compositions according to the present invention is that they show excellent bleaching performances upon storage. The cleaning performances of the colored bleaching composition are therefore maintained.

Tri-Methoxy Benzoic Acid

As another essential ingredient, the compositions of the present invention comprise a tri-methoxy benzoic acid or mixture thereof.

Another essential element of the bleaching compositions of the present invention is the presence of a tri-methoxy benzoic acid or a salt thereof (TMBA) as a radical scavenger.

Generally, the tri-methoxy benzoic acid or a salt thereof has the general formula:

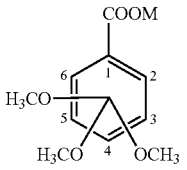

wherein: M is hydrogen, a cation or a cationic moiety. Preferably, M is selected from the group consisting of hydrogen, alkali metal ions and alkaline earth metal ions. More preferably, M is selected from the group consisting of hydrogen, sodium and potassium. Even more preferably, M is hydrogen.

Preferably, said tri-methoxy benzoic acid or a salt is selected from the group consisting of 3,4,5-trimethoxy benzoic acid, a salt thereof, 2,3,4-trimethoxy benzoic acid, a salt thereof, 2,4,5-trimethoxy benzoic acid, a salt thereof and mixture thereof. More preferably, said alkoxylated benzoic acid or the salt thereof is 3,4,5-trimethoxy benzoic acid or a salt thereof. Even more preferably, said alkoxylated benzoic acid or the salt thereof is 3,4,5-trimethoxy benzoic acid.

Suitable trimethoxy benzoic acids or salts thereof are commercially available from Aldrich, Merck or Hunan Shineway.

Typically, the bleaching composition herein may comprise from 0.001% to 5%, preferably from 0.005% to 3% and more preferably from 0.03% to 2.0% by weight of the total composition of said tri-methoxy benzoic acid or a salt thereof.

It is believed that the use of trimethoxy benzoic acid, such as TMBA, in combination with alkali metal salt of silicate, an alkali metal periodate or mixtures thereof, have a synergetic effect on the stability of the pigment and on the bleaching composition.

Optional pH Buffering Components

In the compositions of the present invention, the presence of a pH buffering component is not compulsory, but is preferred.

It is believed that the presence of a pH buffering component in the compositions of the present invention further contributes to the stability of these compositions, effective whiteness performance as well as to the fabric safety. Indeed, the pH buffering component allows to control the alkalinity in the bleaching solution, i.e. maintain the pH of the bleaching solution at a pH of at least 7.5, preferably at least 8, and more preferably at least 8.5 for a longer period of time starting from the moment at which the dilution is completed (e.g. when the bleaching composition of the present invention is diluted in the bleaching solution at a dilution level of 500:1 (water: composition)). It is believed that the pH buffering component may also contribute to stability of the bleach-unstable ingredients herein.

The pH buffering component ensures that the pH of the composition is buffered to a pH value ranging from 7.5 to 13, preferably from 8 to 12, more preferably from 8.5 to 11.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. More preferably alkali metal salts of carbonate, silicate and borate. The preferred alkali metal salts for use herein are sodium and potassium.

Suitable boron salts or mixtures thereof for use herein include alkali metal salts of borates and alkyl borates and mixtures thereof. Particularly preferred boron salts herein include boric acid, alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g. calcium carbonate resulting in an amount of up to 0.4% by weight of by-product within the hypohalite composition. However, at such amount, the by-product will not have the buffering action defined above.

Liquid bleaching compositions herein may contain an amount of pH buffering component of from 0.5% to 9% by weight, preferably from 0.5% to 5% by weight, and more preferably in an amount of from 0.6% to 3% by weight of the composition.

Optional Surfactants

The liquid compositions of the present invention may comprise a surfactant as an optional ingredient. Said surfactants may be present in the compositions herein in amounts of from 0.1% to 50%, preferably from 0.1% to 40% and more preferably from 1% to 30% by weight of the composition.

Surfactants suitable for use herein include anionic surfactants, nonionic surfactants, cationic surfactants, amphoteric surfactants, zwitterionic surfactants, and mixtures thereof.

In a particularly preferred embodiment the surfactant is selected from the group consisting of alkyl sulphate, alkyl ether sulphate and mixtures thereof.

Suitable anionic surfactants for use in the compositions herein include water-soluble salts or acids of the formula $ROSO_3M$ wherein R preferably is a $C_{10}$-$C_{24}$ hydrocarbyl, preferably linear or branched alkyl having a $C_{10}$-$C_{20}$ alkyl component, more preferably a $C_{12}$-$C_{18}$ linear or branched alkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Other suitable anionic surfactants for use herein are water-soluble salts or acids of the formula $RO(A)_mSO_3M$ wherein R is an unsubstituted $C_6$-$C_{24}$ linear or branched alkyl group having a $C_6$-$C_{24}$ alkyl component, preferably a $C_{10}$-$C_{20}$ linear or branched alkyl, more preferably $C_{12}$-$C_{18}$ linear or branched alkyl, A is an ethoxy or propoxy unit, m is greater than zero, typically between about 0.5 and about 30, more preferably between about 0.5 and about 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate, $C_{12}$-$C_{18}$E(1.0) sulfate, $C_{12}$-$C_{18}$ alkyl polyethoxylate (2.25) sulfate, $C_{12}$-$C_{18}$E(2.25) sulfate, $C_{12}$-$C_{18}$ alkyl polyethoxylate (3.0) sulfate, $C_{12}$-$C_{18}$E(3.0) sulfate, and $C_{12}$-$C_{18}$ alkyl polyethoxylate (4.0) sulfate, $C_{12}$-$C_{18}$E(4.0) sulfate, wherein the counterion is conveniently selected from sodium and potassium.

In a particularly preferred embodiment of the present invention the surfactant system used is an anionic surfactant system, namely alkyl alkoxy (preferably ethoxy) sulphate alone for example alkyl (ethoxy) 3 sulphate or in combination with a co-surfactant, preferably a C2-C10 alkyl sulphate and/or a C8-C22 alkyl or aryl sulphonate like C8-C22 benzene sulphonate and/or another alkyl alkoxy sulphate apart the 3 ethoxylated one. Indeed the presence of said alkyl (ethoxy) 3 sulphate alone or in combination with a co-surfactant provides the desired viscosity to the present compositions and delivers excellent stain removal properties to said compositions especially when used in any laundry application.

Typically compositions according to the present invention have a viscosity between 25 cps and 1500 cps, preferably between 50 cps and 1100 cps, depending of the ratio between $AE_3S$ and the co-surfactant, when measured with a Rheometer like Carri-med CSL2-100® at the following viscosity parameters: angle: 1°58, gap: 60, diameter: 4.0 cm, iner.: 63.60 at a temperature of 25° C. and a shear rate of 30 1/sec.

Other anionic surfactants useful for detersive purposes can also be used herein.

Particularly suitable nonionic surfactants for use herein are capped nonionic ethoxylated surfactants according to the formula:

$$R_1(OR_2)_nOR_3$$

wherein $R_1$ is a $C_8$-$C_{18}$ linear or branched alkyl or alkenyl group, aryl group, alkaryl group, preferably, $R_1$ is a $C_{10}$-$C_{15}$ alkyl or alkenyl group, more preferably a $C_{10}$-$C_{15}$ alkyl group; $R_2$ is a $C_2$-$C_{10}$ linear or branched alkyl group, preferably a $C_4$ group; $R_3$ is a $C_1$-$C_{10}$ alkyl or alkenyl group, preferably a $C_1$-$C_5$ alkyl group, and n is an integer ranging in the range of from 1 to 20, preferably from 1 to 10, more preferably from 1 to 5; or mixtures thereof. These surfactants are commercially available from BASF under the trade name Plurafac®, from HOECHST under the trade name Genapol® or from ICI under the trade name Symperonic®. Preferred capped nonionic ethoxylated surfactant of the above formula are those commercially available under the tradename Genapol® L 2.5 NR from Hoechst, and Symperonic® LF/CS 1100 from ICI.

Other suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Other suitable nonionic surfactants for use herein include the amine oxides corresponding to the formula:

$$RR'R''N\rightarrow O$$

wherein R is a primary alkyl group containing 6-24 carbons, preferably 10-18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10-18 carbons and R' and R" are both methyl. Exemplary of the preferred amine oxides are the N-decyldimethylamine oxide, N-dodecyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable nonionic surfactants for the purpose of the invention are the phosphine or sulfoxide surfactants of formula:

$$RR'R''A\rightarrow O$$

wherein A is phosphorus or sulfur atom, R is a primary alkyl group containing 6-24 carbons, preferably 10-18 carbons, and wherein R' and R" are, each, independently selected from methyl, ethyl and 2-hydroxyethyl. The arrow in the formula is a conventional representation of a semi-polar bond.

Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378. Additional synthetic detergents and listings of their commercial sources can be found in McCutcheon's Detergents and Emulsifiers, North American Ed. 1980.

Brighteners

The compositions according to the present invention may optionally also comprise a brightener or mixture thereof as an optional ingredient.

Naturally, for the purpose of the invention, the brightener has to be stable to the hypohalite bleach. The brighteners may be desired herein to further enhance the whiteness performance of the compositions herein.

Brighteners are compounds which have the ability to fluorescent by absorbing ultraviolet wave-lengths of light and re-emitting visible light. Brighteners, also referred to as fluorescent whitening agent (FWA), have been extensively described in the art, see for instance EP-A-0 265 041, EP-A-0 322 564, EP-A-0 317 979 or "Fluorescent whitening agents" by A. K. Sarkar, published by MERROW, especially page 71-72.

Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof.

Examples of optical brighteners which are useful in the present compositions are those identified in U.S. Pat. No. 4,790,856. These brighteners include the PHORWHITE® series of brighteners from Verona. Other brighteners disclosed in this reference include: Tinopal-UNPA®, Tinopal CBS® and Tinopal 5BM® available from Ciba-Geigy; Artic White CC® and Artic White CWD®; the 2-(4-styryl-phenyl)-2H-naptho[1,2-d]triazoles; 4,4'-bis(1,2,3-triazol-2-y1)-stilbenes; 4,4'-bis(styryl)bisphenyls; and the aminocoumarins.

Further specific examples of brighteners useful in the present invention include the polycyclic oxazole derivatives such as benzo-oxazole derivatives, or mixtures thereof and particularly preferred herein the benzo-oxazole derivatives. An example of such a brightener is benzoxazole, 2,2'-(thiophenaldyl)bis having the following formula C18H10N2O2S, commercially available from Ciba-Geigy under the trade name Tinopal SOP®. This brightener is almost insoluble in water, i.e. it has a solubility being lower than 1 gram per liter. Another example of such a brightener is bis(sulfobenzofuranyl)biphenyl, commercially available from Ciba-Geigy under the trade name Tinopal PLC®.

Typically the compositions according to the present invention comprise up to 1.0% by weight of the total composition of a brightener or mixture thereof, preferably from 0.005% to 0.5%, more preferably from 0.005% to 0.3% and most preferably from 0.008% to 0.1%.

Optional Chelating Agents

The compositions according to the present invention may optionally also comprise a chelating agent as an optional ingredient.

Suitable chelating agents may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof.

Chelating agents may be desired in the compositions of the present invention, preferably phosphate chelating agents like phytic acid, as they further contribute to the benefit delivered by the radical scavengers herein by further improving the stability of the brighteners, thus delivering effective whiteness performance in any laundry application upon ageing of the compositions, i.e. after prolonged periods of storage.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Suitable phosphate chelating agents for use in the compositions of the present invention are described in EP-A-0 867 502 in the section titled "The Phosphate ingredient", such ingredients are specifically incorporated herein by reference, especially for their fabric whitening benefit (i.e., yellowing prevention effect) and/or fabric safety benefit. All phosphate ingredients described in EP-A-0 867 502 in the section titled "The Phosphate ingredient" are suitable for use herein. Preferred phosphate chelating agents for use herein are linear phosphate ingredients, wherein R in the formula in the section titled "The Phosphate ingredient" of EP-A-0 867 502 is M and wherein n is 1 (pyrophosphate) or n is 2 (tripolyphosphate (STPP)), most preferably wherein n is 2. The most commonly available form of these phosphates is where M is Sodium. Indeed, preferred phosphate chelating agents for use in the compositions of the present invention are pyrophosphate and/or tripolyphosphate (STPP), more preferably Na phosphate and/or Na tripolyphosphate (STPP).

Phytic acid, which is particularly suitable for use herein, is a hexa-phosphoric acid that occurs naturally in the seeds of many cereal grains, generally in the form of the insoluble calcium-magnesium salt. It may also be derived from corn steep liquor. Commercial grade phytic acid is commercially available from J. T. Baker Co., e.g. as a 40% aqueous solution. It is intended that the present invention covers the acidic form of phytic acid as well as alkali metal salt derivatives thereof, particularly sodium or potassium salts thereof. Sodium phytate is available from Jonas Chemical Co (Brooklyn, N.Y.). In fact since the typical pH of the compositions of the present invention are in the alkaline pH range, the phytic acid component exists primarily as the ionized salt in the liquid compositions herein even if it is added in its acidic form. Mixtures of such salts of phytic acid are also covered.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Particularly preferred chelating agents for use herein are phosphate chelating agents like sodium pyrophosphate, sodium tripolyphosphate, phytic acid, and mixtures thereof.

Typically, the compositions herein comprise up to 10%, preferably from 0.01% to 5% by weight, more preferably from 0.05% to 2% and most preferably from 0.1% to 1.5% by weight of the composition of a chelating agent or mixture thereof.

Builder

A further optional ingredient of the present composition is a builder. Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Other Optional Ingredients

The bleaching compositions herein may further comprise a variety of optional ingredients such as bleach activators, soil suspenders, soil suspending polyamine polymers, polymeric soil release agents, foam reducing systems/agents, catalysts, dye transfer agents, perfumes, hydrotropes and solvents.

Process of Treating Surfaces

In the present invention, the bleaching composition can be used to treat surfaces. By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

By "treating a surface", it is meant herein bleaching and/or disinfecting said surfaces as the compositions of the present invention comprise a hypohalite bleach and cleaning, i.e. removing various types of stains from the surfaces.

Thus, the present invention also encompasses a process of treating (e.g. bleaching) a fabric, as the inanimate surface. In such a process a fabric is contacted with a composition according to the present.

This can be done either in a so-called "pretreatment mode", where a liquid bleaching composition, as defined herein, is applied neat onto said fabrics before the fabrics are rinsed, or washed then rinsed, or in a "soaking mode" where a liquid bleaching composition, as defined herein, is first diluted in an aqueous bath and the fabrics are immersed and soaked in the bath, before they are rinsed, or in a "through the wash mode", where a liquid bleaching composition, as defined herein, is added on top of a wash liquor formed by dissolution or dispersion of a typical laundry detergent. It is also essential in both cases, that the fabrics be rinsed after they have been contacted with said composition, before said composition has completely dried off.

The processes of treating surfaces fabrics according to the present invention, especially fabrics, delivers effective whiteness performance and/or effective stain removal performance upon ageing of the compositions.

The compositions according to the present invention are preferably contacted to fabrics in a liquid form. Indeed, by "in a liquid form", it is meant herein the liquid compositions according to the present invention per se in neat or diluted form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine. Said compositions can be diluted up to 500 times, preferably from 5 to 200 times and more preferably from 10 to 80 times.

More specifically, the process of bleaching fabrics according to the present invention comprises the steps of first contacting a fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted together with the bleaching of said fabrics by contacting said fabrics at the same time with a bleaching composition according to the present invention, or said washing may be conducted before or after that said fabrics have been bleached.

Accordingly, said process allows to bleach fabrics and optionally to wash fabrics with a detergent composition comprising at least one surface active agent before the step of contacting said fabrics with said bleaching composition and/or in the step where said fabrics are contacted with said bleaching composition and/or after the step where said fabrics are contacted with the bleaching composition and before the rinsing step and/or after the rinsing step.

In another embodiment of the present invention the process of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 30 minutes, preferably 1 minute to 10 minutes and then rinsing said fabrics with water. If said fabrics are to be washed, i.e., with a conventional composition comprising at least one surface active agent, said washing may be conducted before or after said fabrics have been bleached. In the embodiment of the present invention wherein the fabric is contacted with a bleaching composition of the present invention in its neat form, it is preferred that the level of hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach, despite a standing prejudice against using hypochlorite-containing compositions neat on fabrics.

It is preferred to perform the bleaching process herein before said fabrics are washed. Indeed, it has been observed that bleaching said fabrics with the compositions according to the present invention (diluted and/or neat bleaching processes) prior to washing them with a detergent composition provides superior whiteness and stain removal with less energy and detergent than if said fabrics are washed first, then bleached.

Alternatively instead of following the neat bleaching process as described herein above (pretreater application) by a rinsing step with water and/or a conventional washing step with a liquid or powder conventional detergent, the bleaching pre-treatment operation may also be followed by the diluted bleaching process as described herein before either in bucket (hand operation) or in a washing machine.

In another embodiment the present invention also encompasses a process of treating a hard-surface, as the inanimate surface. In such a process a composition, as defined herein, is contacted with the hard-surfaces to be treated. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form typically up to 200 times their weight of water, preferably into 80 to 2 times their weight of water, and more preferably 60 to 2 times.

When used as hard surfaces bleaching/disinfecting compositions the compositions of the present invention are easy to rinse and provide good shine characteristics on the treated surfaces. By "hard-surfaces", it is understood any hard-surfaces as mentioned herein before as well as dishes.

The following examples will further illustrate the present invention

Example 1

The following compositions are made by mixing the listed ingredients in the listed proportions (weight % unless otherwise specified).

| | Compositions | | | | | | |
|---|---|---|---|---|---|---|---|
| | I | II | III | IV | V | VI | VII |
| Sodium hypochlorite | 4.0 | 3.0 | 3.0 | 2.5 | 3.0 | 1.0 | 3.0 |
| Sodium hydroxide | 1.0 | 1.4 | 1.0 | 0.5 | 1.2 | 1.0 | 1.4 |
| Sodium carbonate | 1.75 | 1.0 | 1.7 | 0.5 | 1.2 | 1.7 | 1.0 |
| $NaC_{12}/C_{14}E_3S$ | — | — | — | — | 1.0 | 2.0 | 2.3 |
| $NaC_{12}/_{14}S$ | — | — | — | — | 0.1 | 0.2 | 0.1 |
| $C_{12/14}$ dimethyl amine oxide | 0.25 | 1.0 | 2.0 | — | — | — | — |
| Sodium Silicate | 0.2 | 0.2 | 0.1 | — | 0.1 | — | 0.5 |
| Potassium periodate | — | 0.1 | 0.1 | 0.2 | — | 0.05 | — |
| TMBA | 0.1 | 0.05 | 0.2 | 0.1 | 0.1 | 0.05 | 0.3 |
| CuPht (ppm) | 10 | 15 | 5 | 20 | 15 | 10 | 10 |
| Minors and water | balance up to 100% | | | | | | |

The pH of these examples is 8 or above.

Na $C_{12}/C_{14}$ $E_3S$ is $C_{12}$-$C_{14}$ Sodium alkyl (ethoxy) 3 sulphate.

$NaC_{12}/_{14}S$ is $C_{12}$-$C_{14}$ Sodium alkyl sulphate.

TMBA is 3,4,5-trimethoxy benzoic acid commercially available from Hunan Shineway.

CuPht is blue copper phtalocyanine commercially available from BASF.

Example 2

The compositions VIII, IX and X are meant to exemplify compositions according to the present invention but are not necessarily used to limit or otherwise define the scope of the present invention. Compositions A and B are comparative examples. These compositions are made by combining the listed ingredients in the listed proportions (weight % unless otherwise specified). Compositions A, B and VIII to X are illustrated in Table A.

The bleach-stability of different compounds: TMBA, Pigment and Available chlorine ($AvCl_2$) have been assessed in the laboratory using a rapid ageing test. Such a rapid ageing test simulates, under laboratory conditions, the prolonged storage conditions after the manufacture of the bleaching compositions herein. The compositions are stored for 15 days at 50° C.±0.5° C. and the activity of said compound is assessed after 5, 7, 9, 12 and 15 days of storage.

In a rapid ageing test, compositions A, B, VII, IX and X are tested for bleach stability, TMBA stability and dye stability. The percentage of compounds which remains in the composition is illustrated in Table B.

TABLE A

| | Compositions | | | | |
|---|---|---|---|---|---|
| | A | B | VIII | IX | X |
| Sodium hypochlorite | 3.0 | 3.0 | 3.0 | 3.0 | 3.0 |
| Sodium hydroxide | 1.2 | 1.2 | 1.2 | 1.2 | 1.2 |
| Sodium carbonate | 1.2 | 1.2 | 1.2 | 1.2 | 1.2 |
| $NaC_{12}/C_{14}E_3S$ | 1.0 | 1.0 | 1.0 | 1.0 | 1.0 |
| $NaC_{12}/C_{14}S$ | 0.1 | 0.1 | 0.1 | 0.1 | 0.1 |
| Sodium Silicate | — | — | 0.2 | — | 0.1 |
| Potassium periodate | — | — | — | 0.2 | 0.1 |
| HEDP | — | 0.2 | — | — | — |
| TMBA | 0.1 | 0.1 | 0.1 | 0.1 | 0.1 |
| Copper Phtalocyanine | 15 ppm | 15 ppm | 15 ppm | 15 ppm | 15 ppm |
| Minors and water | balance up to 100% | | | | |

TABLE B

| Compositions: | 5 days | 7 days | 9 days | 12 days | 15 days |
|---|---|---|---|---|---|
| % of AvCl2 loss | | | | | |
| A | 25 | 45 | 60 | 85 | 100 |
| B | 20 | 35 | 49 | 70 | 90 |
| VIII | 12 | 19 | 25 | 29 | 40 |
| IX | 17 | 24 | 29 | 35 | 45 |
| X | 13 | 19 | 24 | 27 | 32 |
| % of pigment loss | | | | | |
| A | 75 | 100 | 100 | 100 | 100 |
| B | 45 | 70 | 100 | 100 | 100 |
| VIII | 25 | 25 | 35 | 50 | 70 |
| IX | 55 | 65 | 75 | 88 | 100 |
| X | 20 | 25 | 30 | 42 | 55 |
| % of TMBA loss | | | | | |
| A | 77 | 98 | 100 | 100 | 100 |
| B | 59 | 88 | 100 | 100 | 100 |
| VIII | 34 | 50 | 67 | 75 | 85 |
| IX | 53 | 75 | 89 | 100 | 100 |
| X | 32 | 45 | 55 | 62 | 75 |

These data clearly show that the bleaching composition of the present invention, i.e. comprising an alkali metal salt of silicate, an alkali metal periodate or mixture thereof, have an excellent effect on the chemical stabilization of the bleaching composition and prevent the decomposition of the available chlorine, of pigment and/or dye and of radical scavengers present in said composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid bleaching composition comprising:

i) 1% to 3% of a hypohalite bleach, ii) 0.05% to 0.3% of a trimethoxy benzoic acid or a salt thereof, iii) a pigment and/or a dye; and iv) from 0.05% to 0.2% of an alkali metal salt of silicate and from 0.05% to 0.2% of an alkali metal periodate.

2. The liquid bleaching composition according to claim 1 wherein the alkali metal salt of silicate comprises sodium silicate and wherein the alkali metal periodate comprises potassium periodate.

3. The liquid bleaching composition according to claim 1 wherein the pigment and/or dye comprises a copper-phthalocyanine pigment.

4. The liquid bleaching composition according to claim 1 wherein said trimethoxy benzoic acid is selected from the group consisting of 3,4,5-trimethoxy benzoic acid, a salt thereof; 2,3,4-trimethoxy benzoic acid, a salt thereof; 2,4,5-trimethoxy benzoic acid, a salt thereof and combinations thereof.

5. The liquid bleaching composition according to claim 1 wherein said trimethoxy benzoic acid comprises 3,4,5-trimethoxy benzoic acid or a salt thereof.

6. The liquid bleaching composition according to claim 1 wherein said hypohalite bleach comprises an alkali metal and/or an alkaline earth metal hypochlorite.

7. A method of treating a surface with a composition such as defined in claim 1, said process comprising the steps of applying said composition, in its neat form, in its diluted form, or in its dissolved or dispersed form, onto at least a portion of a surface, for a period of time sufficient to bleach said surface, before said surface is washed and/or rinsed.

8. The method according to the claim 7 wherein said surface is a fabric.

9. A liquid bleaching composition comprising:

i) 1% to 6% of a hypohalite bleach, ii) 0.05% to 0.2% of a trimethoxy benzoic acid or a salt thereof, iii) a pigment and/or a dye; and iv) from 0.05% to 0.2% of an alkali metal salt of silicate.

* * * * *